US006505799B1

(12) United States Patent
Bercaw et al.

(10) Patent No.: US 6,505,799 B1
(45) Date of Patent: Jan. 14, 2003

(54) ICE SCREW WITH NON-LINEAR TAPER

(75) Inventors: John Bercaw, Salt Lake City, UT (US); Chris Harmston, Sandy, UT (US); William J. Reimann, Salt Lake City, UT (US); Paul Tusting, Salt Lake City, UT (US); Tyler Warner, Salt Lake City, UT (US)

(73) Assignee: Black Diamond Equipment, Ltd. Inc., Salt Lake City, UT (US)

( * ) Notice: Subject to any disclaimer, the term of this patent is extended or adjusted under 35 U.S.C. 154(b) by 0 days.

(21) Appl. No.: 10/039,222

(22) Filed: Jan. 4, 2002

(51) Int. Cl.[7] ..... A47F 5/08

(52) U.S. Cl. ..... 248/231.9; 248/231.91; 248/925; 248/694; 411/400; 411/401; 411/411

(58) Field of Search ..... 248/231.9, 231.91, 248/925, 694; 482/37; 411/400, 401, 411, 387.1–387.8

(56) References Cited

U.S. PATENT DOCUMENTS 5,118,061 A 6/1992 Byrne et al.
5,347,718 A 9/1994 Turner
5,782,442 A 7/1998 Kwak et al.
6,068,226 A * 5/2000 Anders ..... 248/231.91
2001/0024608 A1 * 9/2001 Petzl et al. ..... 411/400

FOREIGN PATENT DOCUMENTS

GB 9987 4/1911

OTHER PUBLICATIONS

Grivel Mont Blanc, brochure, 1996.
Trango: USA Ltd. brochure.
Charlet Moser brochure.

* cited by examiner

*Primary Examiner*—Leslie A. Braun
*Assistant Examiner*—Deborah M. Brann
(74) *Attorney, Agent, or Firm*—Thorpe North & Western

(57) ABSTRACT

An ice screw device for winter, alpine and ice climbing includes a banger couplable to a tubular shank with a screw thread. The tubular shank includes an ice engaging portion configured to be inserted into ice, a tip, and a head portion. The ice engaging portion includes a length and a reverse taper. A majority of the reverse taper of the ice engaging portion is located proximate the tip and within less than half of the length of the ice engaging portion from the tip. In addition, the taper of the ice engaging portion is non-linear. The ice engaging portion of the tubular shank can have at least two sections.. A first section nearer the tip has a first taper different from a second taper of a second section nearer the head portion.

20 Claims, 1 Drawing Sheet

ICE SCREW WITH NON-LINEAR TAPER

BACKGROUND OF THE INVENTION

1. Field of the Invention

The present invention relates generally to an ice screw used in ice climbing and the like for securing a carabiner and the like to a body of ice.

2. Related Art

Extreme sports have become increasingly popular. An example of such an extreme sport includes winter, alpine or ice climbing. Ice climbing is similar to rock or cliff climbing, but includes the added challenge or obstacle of bodies of ice, such as frozen waterfalls, or snow packed cliffs. Thus, ice climbers seek out these conditions because of the added difficulty and challenge.

Ice climbing, like other types of climbing, requires special equipment. Some gear, such as an ice axe and crampons (special, spiked boot treads), assist the climber in grasping the surface or terrain being climbed. Other gear, such as rope, pitons (spikes), and carabiners, acts as safety or back-up systems to catch the climber if the need arises.

It will be appreciated that a climber, suspended hundreds of feet in the air on a slab of ice, has certain expectations and requirements for climbing equipment. For example, it is critical that the gear be strong enough to hold the weight of the climber, dynamic loading of a falling climber, capable of being attached to and holding the climbing surface (holding power), light enough to be carried, and quickly and easily utilized. A climber does not want to carry any more equipment than is necessary, or equipment that is difficult to use.

Initially, much of the gear used in winter, alpine, or ice climbs was the same gear used in rock climbing. For example, rock pitons would be driven into the ice, just as they had been driven into cracks in the rock. Some modifications were made to the rock piton to improve performance on the ice, such as the addition of teeth, a U-shaped shaft, and a hollow tube. Hammering these devices into the ice, however, was inherently dangerous as the hammering could shatter the ice and compromise its integrity. A corkscrew type device was developed that could be twisted into the ice without as much danger of fracturing the ice, but it had little shear strength. The most popular design has been the modem, twist-in, tubular design, or ice screw. The twist-in tube does not fracture the ice as much as the hammered-in piton type, and has greater strength than the corkscrews.

Typically, an ice screw is a hollow shaft having an external screw thread. One end has sharp teeth for piercing the ice, and the other end has a head or rim. A hanger is attached to the shaft at the head, and has an opening or eye for clipping on a carabiner. The hanger can be secured to the shaft such that they turn together, and the hanger can be used to turn or screw the shaft into the ice. The climber typically forces the toothed end of the ice screw into the ice, and screws it into the ice using the hanger as a lever arm. A rope, secured to the climber, can be passed through the carabiner to secure the climber to the ice screw, and thus to the ice. Handles have been developed, that attach to the screw or hanger, to facilitate screwing the shaft into the ice.

It also will be appreciated that turning or screwing the shaft into the ice can be a difficult job due to friction between the ice and the screw. The further the shaft is inserted into the ice, the more difficult it can be to turn. It has been proposed to provide the shaft of these screws with a constant or linear reverse taper from the toothed end to the head, so that the toothed end has a larger diameter than the head. The larger diameter of the toothed end creates a larger hole in the ice to reduce the friction with the rest of the shaft. In reality, however, it is difficult and expansive to provide such a taper on an ice screw. Special machines and extra effort are required to obtain such a taper. In addition, it is often difficult to ascertain whether or not the screw even has a taper.

SUMMARY OF THE INVENTION

It has been recognized that it would be advantageous to develop an ice screw that is easier and faster to use.

The invention provides an ice screw device with at least one screw thread formed on a tubular shank or shaft. The tubular shank includes an ice engaging portion to be introduced into ice, a distal tip, and a proximal head portion. A hanger can be coupled to the head portion of the shank to allow climbing equipment, such as a carabiner, to be coupled to the tubular shank. In addition, the ice engaging portion of the tubular shank can include a reverse taper.

In accordance with another more detailed aspect of the present invention, the ice screw device advantageously includes a majority of the reverse taper of the ice engaging portion being located proximate the tip and within less than half a length of the ice engaging portion. Thus, a majority of the reverse taper can be located within the first two inches of the ice engaging portion of the tubular shank. It has been found that such a configuration of the ice engaging portion is faster and easier to insert into the ice. In addition, it is believed that concentrating a majority of the taper in a smaller section or length also provides a taper that is more visible, thus making the taper easier to visually verify by the climber. In addition, it is believed that providing a more visible taper provides a marketing benefit because the climber is able to see the taper at the point of purchase.

In accordance with another more detailed aspect of the present invention, the ice engaging portion of the ice screw device advantageously includes a non-linear, varying, or non-constant taper. The ice engaging portion can include at least two sections having different tapers. In one aspect, a first section nearer the tip can have first taper, or first reverse taper, greater than a second taper, or second reverse taper, of a second section nearer the head portion. Again, it has been found that such a configuration is easier to insert into the ice.

Additional features and advantages of the invention will be apparent from the detailed description which follows, taken in conjunction with the accompanying drawings, which together illustrate, by way of example, features of the invention.

DETAILED DESCRIPTION

Figure 1:
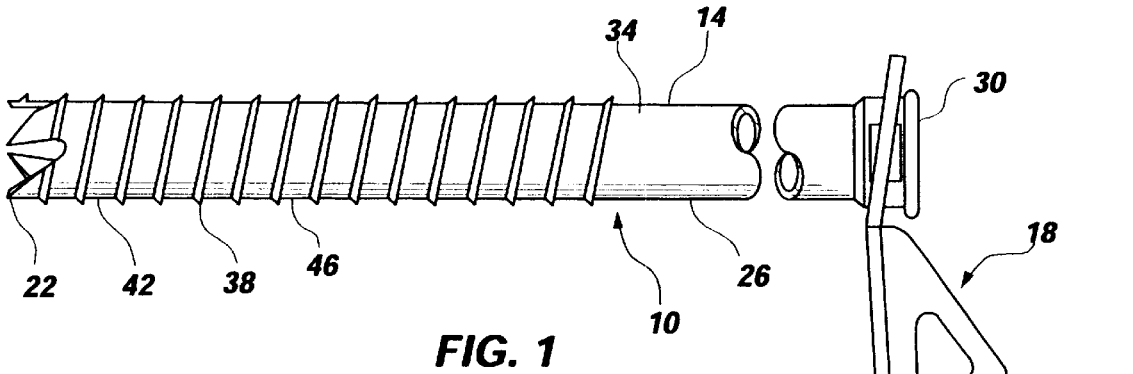
FIG. 1 is a side view of an ice screw device in accordance with an embodiment of the present invention.

Reference will now be made to the exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention.

Figure 3:
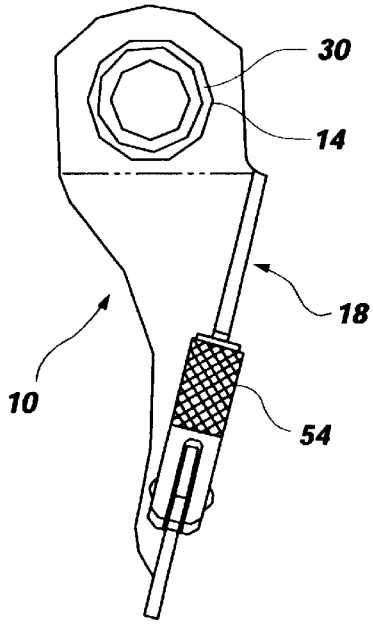
FIG. 3 is an end view of the ice screw device of FIG. 1.
Figure 2:
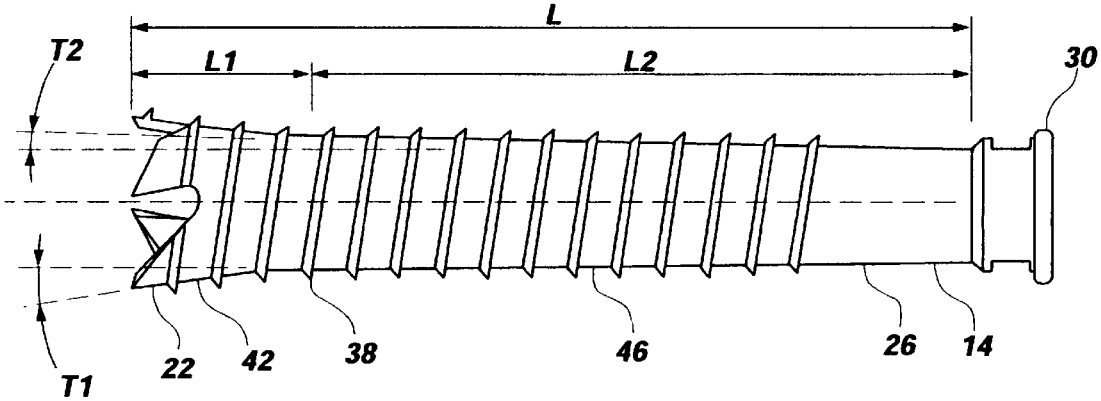
FIG. 2 is an exaggerated schematic view of a shaft of the ice screw device of FIG. 1.

As illustrated in FIGS. 1–3, an ice screw, indicated generally at 10, in accordance with the present invention is shown for being inserted into ice or snow for use in winter, alpine or ice climbing, or the like. The ice screw 10 can include an elongated tubular shank or shaft 14, and a hanger 18 attached thereto. The tubular shank or shaft 14 is designed to be inserted into the ice or snow. The hanger 18 is designed to allow attachment of climbing gear, such as a carabiner, to the tubular shank 14, and thus to the ice. It is of course understood that climbing gear can be attached to the tubular shank 14 of the ice screw 10 in various different ways. Thus, the ice screw 10 allows a climber to be secured to the ice, by allowing a carabiner and/or other climber gear attached to the climber to be attached to the hanger 18, which is coupled to the tubular shaft 14 secured in the ice.

The tubular shaft 14 includes a distal tip 22 for initially engaging the ice, an ice engaging portion 26 for being inserted into the ice, and a proximal head or head portion 30. Teeth can be formed on the tip 22 to facilitate driving the tubular shank 14 into the ice. The ice screw 10 can be initially inserted into the ice, or can initially engage the ice, by driving the tip 22 into the ice, such as with an ice axe. The ice engaging portion 26 can extend from the tip 22 to the head or head portion 30 (having a length L as shown in FIG. 3) such that almost all of the tubular shank 14 can be inserted into the ice, and with the head portion 30 extending from the ice. The hanger 18 can be coupled to the head or head portion 30 outside of the ice.

The tubular shaft 14 also includes a hollow interior and an exterior surface 34. One or more screw threads 38 can be formed on the tubular shank 14 or exterior surface 34. The screw thread 38 can be designed to engage the ice. For example, the leading side of the thread 38 can be angled to be driven into the ice, while the trailing side can be more abrupt to abut to the ice, and resist removal. The tubular shank 14 can be inserted into the ice by turning the shank 14. The hanger 18, and a crank handle described below, can be utilized to turn the shank 14. The screw thread 38 advances the shank 14 into the ice as the shank is turned.

The ice engaging portion 26 of the tubular shank 14 can have a reverse taper, or a reverse rate of taper. Thus, the tubular shank 14 has a diameter that reduces along its length from the tip 22 to the head portion 30, so that the diameter of the shank 14 is greater at the tip 22, and less at a location adjacent to the head portion 30. In addition, the ice engaging portion 26 of the tubular shank 14 advantageously has a non-linear, non-constant or variable taper. Preferably, a majority of the reverse taper of the ice engaging portion 26 is located proximate to, or adjacent to, the tip 22, so that a majority of the reverse taper occurs near the tip 22.

As discussed above, although it has been proposed to continuously or linearly taper the ice engaging portion from tip to head (or have a single linear taper). It has been found by the inventors herein that a non-linear or variable taper can provide certain advantages. For example, it has been found that concentrating a majority of the reverse taper near the tip 22 allows the ice screw 10 to be inserted into the ice faster and easier than non-tapered screws, or linearly tapered screws.

The ice engaging portion 26 of the tubular shank 14 can have a first section 42 at the tip 22 in which a majority of the taper occurs. The first section 42 can have a length L1, that preferably is less than half (or 50%) of the length L of the ice engaging portion 26, and more preferably is less than approximately 25% to 7% of the length L of the ice engaging portion 26. For example, the first section 42 can have a length L1 preferably less than approximately 2 inches, and more preferably approximately 1 inch. It has been found by the inventors that having a majority of the reverse taper in the first inch, or first 25% to 7%, of the tubular shaft 14 is faster and easier to insert into the ice. In addition, it is believed that concentrating a majority of the taper in a smaller section or length also provides a taper that is more visible, thus making the taper easier to visually verify by the climber. In addition, it is believed that providing a more visible taper provides a marketing benefit because the climber is able to see the taper at the point of purchase. While concentrating the taper within the first 25% has been found to provide advantages, it is believed that advantages can be obtained by concentrating the taper within a larger distance, or within the first half of the ice engaging portion.

In addition, the ice engaging portion 26 of the tubular shank 14 advantageously can have different tapers. Thus, the ice engaging portion 26 can have two or more sections, such as the first section 42 nearer the tip 22, and a second section 46 nearer the head portion 30. Like the first section 42, the second section 46 can have a length L2. The first and second sections 42 and 46 have different tapers, or different rates of taper. As described above, the first section 42 can have a reverse taper, and a majority of the taper. Thus, the first section 42 can have a greater taper, and a greater reverse taper, than the second section 46.

For example, the first section 42 can have a taper T1 of approximately ±0.015 inches diameter per inch of length, while the second section 46 can have a taper T2 of approximately ±0.002 inches diameter per inch of length. Thus, for example, the tubular shank 14 can have a length of approximately 6.3 inches, a diameter adjacent the head portion 30 of approximately 0.65 inches, a diameter between the first and section sections 42 and 46 of approximately 0.66 inches, and a diameter at the tip 22 of approximately 0.675 inches. It is of course understood that the ice screw can have different lengths and diameters. It has been found by the inventors that the two sections of different reverse taper allow the tubular shaft to be inserted into ice faster and easier than non-tapered screws, or linearly tapered screws. It is of course understood that the above tapers are examples of the presently preferred tapers that have been found acceptable by the inventors, and that other tapers and dimensions may be possible. For example, it is believed to be possible to provide the first section with a reverse taper, as described above, and the second section without a taper (or a taper of zero). Providing a majority of the reverse taper in the first section 42 near the tip 22, and/or providing different tapers on the first and second sections 42 and 46, has been found to allow the tubular shaft 14 to be inserted into the ice faster and easier than non-tapered screws, or linearly tapered screws.

The taper on the ice engaging portion 26 has been described above as including two linear tapers, such as the first reverse taper proximate the tip, and the second reverse taper different from the first reverse taper. Other non-linear or variable tapers are believed to be possible. For example, three or more different linear tapers can be provided. As another example, the taper or tapers can be curved, or can be logarithmic or polynomial. In addition, the screw can be stepped.

As described above, the hanger 18 can be attached to the head portion 30 of the tubular shank 14. The hanger 18 can have an aperture 50 to which climbing equipment, such as a carabiner, can be attached. The hanger 18 can have an aperture through which the head portion 30 of the shank 14 is received. Flats can be formed in the aperture of the hanger to match or mate with flats on the head portion 30 to journal the hanger 18 and tubular shank 14 together. Thus, the hanger 18 and shank 14 rotate together, and the hanger 18 can be used as a lever arm to assist in rotating the shank 14. The hanger 18 can include a crank handle 54 to facilitate turning or driving the ice screw 10. The crank handle 54 can be pivotally coupled to the hanger 18, and pivot into an indentation when not in use. Such a crank handle, and other aspects of an ice screw, is described in U.S. Pat. No. 5,782,442, which is herein incorporated by reference.

It is of course understood that climbing equipment can be attached or coupled to the shank in various different ways, and that various different hanger designs are possible. For example, the hanger can be a loop of material, such as metal or fabric. The hanger is one example of means for coupling climbing equipment to the tubular shaft. It is of course understood that other means for coupling can be used, including for example, metal hangers without crank handles, metal loops, cloth or fabric loops, straps, etc. A separate crank handle, in addition to the hanger, also can be provided, as is known in the art.

The ice screw 10 can be formed of a strong, light-weight, and corrosion-resistant material. It is desirable for the ice screw to be light-weight because it must be carried, along with other climbing gear, by the climber. It is desirable for the ice screw to be strong because it may need to support the weight of the climber, and/or the dynamic loading of a falling climber. It is desirable that the ice screw be corrosion resistant because it will be used in conditions in which it will most likely get wet. The tubular shank 14 can be formed of metal, and can be plated. The desired dimensions of the tubular shank 14, and the screw threads 38, can be formed by machining. The hanger 18 also can be formed of metal. The shape, dimensions, and apertures of the hanger can be formed by stamping. The ice screw 10 can be assembled by inserting the tubular shank 14 through the aperture in the hanger 18, and swaging or crimping the hanger to secure the hanger to the shank. The swaging or crimping reduces the diameter of the aperture in the hanger, and can form the flats.

It is to be understood that the above-referenced arrangements are only illustrative of the application for the principles of the present invention. Numerous modifications and alternative arrangements can be devised without departing from the spirit and scope of the present invention while the present invention has been shown in the drawings and fully described above with particularity and detail in connection with what is presently deemed to be the most practical and preferred embodiments(s) of the invention, it will be apparent to those of ordinary skill in the art that numerous modifications can be made without departing from the principles and concepts of the invention as set forth in the claims.

What is claimed is:

1. An ice screw device, comprising:

a) a tubular shank, including: an ice engaging portion configured to be introducible into ice, a distal tip, and a proximal head portion configured to facilitate coupling climbing gear to the tubular shaft; and b) at least one screw thread, disposed on the tubular shank; and c) the ice engaging portion including a reverse taper proximate the tip with the tubular shank reducing in outer diameter along at least a portion of the ice engaging portion from the distal tip towards the proximal head portion; and e) the ice engaging portion including a non-linear taper between the distal tip and the proximal head portion.

2. A device in accordance with claim 1, further comprising:

a) a hanger, couplable to the head portion of the tubular shank, configured to be coupled to climbing equipment.

3. A device in accordance with claim 1, wherein the ice engaging portion includes at least two sections having different tapers.

4. A device in accordance with claim 1, wherein the ice engaging portion has at least two sections including a first section nearer the tip and a second section nearer the head portion; and wherein the first section has a greater taper than a taper of the second section.

5. A device in accordance with claim 1, wherein a majority of the taper is located proximate the tip and in less than half of a length of the ice engaging portion.

6. A device in accordance with claim 1, wherein the ice engaging portion has at least two sections including a first section nearer the tip and a second section nearer the head portion; wherein the first section has a reverse taper and a greater taper than the second section; and wherein the first section has a length less than half of a length of the ice engaging portion.

7. A device in accordance with claim 1, wherein a majority of the taper is located proximate the tip and in less than approximately two inches.

8. A device in accordance with claim 1, wherein the ice engaging portion has at least two sections including a first section nearer the tip and a second section nearer the head portion; and wherein the first section has a taper of approximately ±0.015 inches diameter per inch of length; and wherein the second section has a taper of approximately ±0.002 inches diameter per inch of length.

9. A device in accordance with claim 1, wherein the ice engaging portion has at least two sections including a first section nearer the tip and a second section nearer the head portion; and wherein both the first and second sections have a reverse taper; and wherein the reverse taper of the first section is greater than the reverse taper of the second section.

10. An ice screw device, comprising:

a) an elongated tubular shank, including: a hollow interior, a distal tip, a proximal head portion, and an ice engaging portion configured to be introducible into ice;

b) at least one screw thread, disposed on the tubular shank;

c) the ice engaging portion of the tubular shank having at least two sections, including first and second sections, the first section having a reverse taper different from the second section; and d) a hanger, couplable to the head portion, configured to be coupled to climbing equipment.

11. A device in accordance with claim 10, wherein the taper of the first section is greater taper than a taper of the second section.

12. A device in accordance with claim 10, wherein a majority of the taper is located proximate the tip and in less than half of a length of the ice engaging portion.

13. A device in accordance with claim 10, wherein the first section has a reverse taper and a greater taper than the second section; and wherein the first section has a length less than half of a length of the ice engaging portion.

14. A device in accordance with claim 10, wherein the first section has a taper of approximately ±0.015 inches diameter per inch of length; and wherein the second section has a taper of approximately ±0.002 inches diameter per inch of length.

15. A device in accordance with claim 10, wherein both the first and second sections have a reverse taper, and wherein the reverse taper of the first section is greater than the reverse taper of the second section.

16. A device in accordance with claim 10, wherein the ice engaging portion includes a non-linear taper between the tip and the head portion.

17. An ice screw device, comprising:

a) a tubular shank, including: an ice engaging portion configured to be introducible into ice, a distal tip, and a proximal head portion; and b) at least one screw thread, disposed on the tubular shank; and c) a hanger, couplable to the head portion of the tubular shank, configured to be coupled to climbing equipment; and d) the ice engaging portion including a length and a reverse taper; and e) a majority of the reverse taper of the ice engaging portion being located proximate the tip and within less than half of the length of the ice engaging portion.

18. A device in accordance with claim 17, wherein the ice engaging portion includes at least two sections having different tapers.

19. A device in accordance with claim 17, wherein the ice engaging portion has first and second sections including a first section nearer the tip and a second section nearer the head portion; wherein both the first and second sections have a reverse taper; and wherein the reverse taper of the first section is greater than the reverse taper of the second section.

20. A device in accordance with claim 17, wherein the ice engaging portion includes a non-linear taper between the tip and the head portion.

* * * * *